US008525007B2

(12) United States Patent
Fujii

(10) Patent No.: US 8,525,007 B2
(45) Date of Patent: Sep. 3, 2013

(54) ACTION OF UPRIGHT PIANO

(75) Inventor: Yukimitsu Fujii, Kagoshima (JP)

(73) Assignee: Yugen Kaisha Fujii Piano Service, Kagoshima (JP)

( * ) Notice: Subject to any disclaimer, the term of this patent is extended or adjusted under 35 U.S.C. 154(b) by 57 days.

(21) Appl. No.: 13/387,237

(22) PCT Filed: Jul. 23, 2010

(86) PCT No.: PCT/JP2010/004709

§ 371 (c)(1),
(2), (4) Date: Mar. 7, 2012

(87) PCT Pub. No.: WO2011/013334

PCT Pub. Date: Feb. 3, 2011

(65) Prior Publication Data

US 2012/0180614 A1 Jul. 19, 2012

(30) Foreign Application Priority Data

Jul. 29, 2009 (JP) ..... 2009-176144

(51) Int. Cl.
*G10C 5/00* (2006.01)

(52) U.S. Cl.
USPC ..... 84/242; 84/240

(58) Field of Classification Search
USPC ..... 84/236–255
See application file for complete search history.

(56) References Cited

U.S. PATENT DOCUMENTS 2,109,192 A * 2/1938 Davis ..... 84/240
2,329,009 A * 9/1943 Socin ..... 84/240
2,436,875 A * 3/1948 Socin ..... 84/240
2,469,308 A * 5/1949 Montoya ..... 84/240
2,502,107 A * 3/1950 Stein ..... 84/240
2,524,835 A * 10/1950 Ringholz ..... 84/253

(Continued)

FOREIGN PATENT DOCUMENTS

FR 2 652 186 A1 9/1989
JP 57-30791 U 2/1982

(Continued)

OTHER PUBLICATIONS

Nishiguchi et al., "Motto shiritai piano no shikumi", 1st edition, Ongaku No Tomosha, Apr. 30, 2005, pp. 65-77.

*Primary Examiner* — David S. Warren
(74) *Attorney, Agent, or Firm* — Michael D. Bednarek; Axinn, Veltrop Harkrider LLP

(57) ABSTRACT

To provide an action of an upright piano which permits playing of repeated notes on the single key and touch of the keys that are comparable to a grand piano. A first spring (59) is provided to a pushing-up portion (20) of a jack (18), a first spring rest (71) is provided to a jack stop rail (53), and when a jack tail (19) moves away from a regulating button (47), the first spring (59) bent between the pushing-up portion (20) and the first spring rest (71) forces the pushing-up portion (20) to be pushed under a pushed-up portion (27) to be thrust up of a hammer butt (25). A second spring (66) is provided to a damper stop rail (56), a second spring rest (72) is provided to a hammer shank (33), and the second spring (66) bent between the damper stop rail (56) and the second spring rest (72) stops the rotational movement of a hammer (32) before the hammer (32) that moves rotationally by the force of the first spring (59) strikes a string (90).

9 Claims, 10 Drawing Sheets

(56) References Cited

U.S. PATENT DOCUMENTS

| | | | | | |
|---|---|---|---|---|---|
| 2,542,307 | A | * | 2/1951 | Brown | 84/240 |
| 2,571,298 | A | * | 10/1951 | Scott-Huntington | 84/240 |
| 2,637,238 | A | * | 5/1953 | Murdock | 84/240 |
| 3,048,074 | A | * | 8/1962 | Quednau | 84/240 |
| 3,435,720 | A | * | 4/1969 | Eaton | 84/240 |
| 3,946,635 | A | * | 3/1976 | Atsuta | 84/242 |
| 4,119,008 | A | * | 10/1978 | Kimble | 84/242 |
| 5,123,321 | A | * | 6/1992 | Caught | 84/242 |
| 5,353,671 | A | * | 10/1994 | Inoue et al. | 84/236 |
| 5,610,356 | A | * | 3/1997 | Koseki et al. | 84/719 |
| 8,389,833 | B2 | * | 3/2013 | Muramatsu et al. | 84/240 |
| 2011/0232456 | A1 | * | 9/2011 | Muramatsu et al. | 84/241 |
| 2012/0180614 | A1 | * | 7/2012 | Fujii | 84/242 |

FOREIGN PATENT DOCUMENTS

| | | | |
|---|---|---|---|
| JP | 57-124888 | U | 8/1982 |
| JP | 01-161294 | B | 6/1989 |
| JP | 2-126196 | U | 10/1990 |
| JP | 07-160251 | A | 6/1995 |
| JP | 07-175469 | A | 7/1995 |
| JP | 2006-091516 | A | 4/2006 |
| JP | 2006-201504 | A | 8/2006 |

* cited by examiner

ACTION OF UPRIGHT PIANO

This application is a national stage application of International Patent Application No. PCT/JP2010/004709 (WO 2011/013334 A1), filed Jul. 23, 2010, which is herein incorporated by reference in its entirety.

TECHNICAL FIELD

The present invention relates to a method of operating an action of an upright piano, and to an action of an upright piano.

BACKGROUND ART

An action of a typical grand piano is described (see, Non-Patent Document 1). In the following description, the front side seen from the piano player is referred to as "front", the far side is referred to as "back", the left side is referred to as "left", and the right side is referred to as "right". In addition, the expression "key is in its rest position" means that the front of a key is located at the highest point of its travel while the tail of the key is located at the lowest point of its travel.

A piano player depresses a key that is in its rest position. The tail of the key pushes up a wippen. A repetition lever and a jack raise a hammer roller, and a hammer pivots towards a string located above. Almost at the same time, a damper head rises and is released from its contact with the string.

The piano player further depresses the key. Immediately before the hammer reaches the string, a jack tail comes into contact with a regulating button. The jack pivots and a protruding end of the jack slips out from under the hammer roller.

Then, the hammer hits the string. It vibrates and produces a note. After hitting the string, the hammer rebounds and falls. At this point, the protruding end of the jack is no longer under the hammer roller. The hammer roller pushes down the repetition lever. The hammer falls back while receiving a force applied by a repetition spring. A back check catches the hammer.

Next, the piano player releases the key. The wippen falls and the hammer escapes from the back check. The repetition spring pushes up on the repetition lever and raises the hammer roller. As the wippen is at its lower position, the hammer rises slightly. Thus, the jack pivots by the force received from the jack spring. The protruding end of the jack moves back under the hammer roller. Accordingly, the piano player can depress the same key again and make the string vibrate to produce a note. The repetition lever comes into contact with a drop screw and stops the upward motion of the hammer. Subsequently, the hammer falls along with the wippen.

Because of the construction of grand pianos, the front of the key rises by approximately one third of the key dip distance from the lowest point of its travel to its rest position when the protruding end of the jack moves back under the hammer roller. In a grand piano, when the key rises by approximately one third of the key dip distance from the lowest point of its travel to its rest position, the piano player can depress the same key again and make the string vibrate to produce a note. According to a certain experiment that the present inventor knows, the piano player can play 14 repeated notes per second on the same key within a given period of time.

The unique key touch of the grand piano is provided with the following first to third forces. The first force is a force that is transmitted from a repetition spring to the key. The second force is a force that is transmitted to the key when the protruding end of the jack moves back under the hammer roller.

The third force is a force that is transmitted to the key when the repetition lever comes into contact with the drop screw.

An action of a typical upright piano is described (see, Non-Patent Document 1).

A piano player depresses a key that is in its rest position. The tail of the key pushes up a wippen, and the wippen rotates. A protruding end of a pushing-up portion of a jack pushes up a pushed-up portion of a hammer butt. The hammer butt and a hammer pivot towards a string on a hammer butt flange. As the wippen rotates, a damper head is released from its contact with the string.

The piano player further depresses the key. The jack tail strikes a regulating button, and the jack pivots. Then, the protruding end of the pushing-up portion of the jack slips out from under the pushed-up portion of the hammer butt. The hammer is disengaged from the motion of the key. This disengagement is so-called "let-off".

The hammer continues to move towards the string on its own inertia and hits the string, allowing it to vibrate. After hitting the string, the hammer rebounds from the string. A back check catches a catcher, which stops the motion of the hammer.

Next, the piano player releases the key. The wippen falls and the catcher escapes from the back check. In addition, the jack tail escapes from the regulating button. When the wippen completely falls, a gap is formed under the pushed-up portion of the hammer butt into which the protruding end of the pushing-up portion of the jack can be inserted. Then, the jack pivots by the force received from the jack spring. The protruding end of the pushing-up portion of the jack slips under the pushed-up portion of the hammer butt and they engage with each other.

Next, the gap required to engage the jack and the hammer butt in the upright piano is described.

The piano player depresses the key to the lowest point of its travel. Because of the construction of actions of the upright piano, the front of the key falls by approximately 10 mm, the tail of the key pushes up the heel of the wippen by approximately 5 mm, and the jack flange rises by approximately 5 mm. When compared with the key in its rest position, the protruding end of the pushing-up portion of the jack rises by approximately 5 mm after escaping from under the hammer butt. On the other hand, the hammer butt is pushed up by the jack and pivots on the hammer butt flange. The distance between the hammer butt flange and the pushed-up portion of the hammer butt is short. Thus, as the back check catches the catcher, the pushed-up portion of the hammer butt is raised only by approximately 1 mm from its rest position. The values given herein are merely examples. In the upright piano, the amount that the protruding end of the pushing-up portion of the jack is raised is significantly larger than the amount that the pushed-up portion of the hammer butt is raised. As a result, when the wippen falls completely and the key returns to its rest position, a gap is formed under the pushed-up portion of the hammer butt into which the protruding end of the pushing-up portion of the jack can be inserted. Until the key returns to its rest position, there is no such a gap under the pushed-up portion of the hammer butt.

If the protruding end of the pushing-up portion of the jack moves towards under the pushed-up portion of the hammer butt before the key returns to its rest position, the protruding end of the pushing-up portion of the jack hits a surface located in front of and above the pushed-up portion of the hammer butt. The protruding end of the pushing-up portion of the jack cannot be slipped under the pushed-up portion of the hammer butt. Thus, it is impossible to engage the jack and the hammer butt with each other.

When the jack and the hammer butt engage with each other, the piano player can depress the same key again and make the string vibrate to produce a note. According to the aforementioned experiment, the piano player can play 7 repeated notes per second on the same key within a given period of time. This means that the upright piano is inferior to the grand piano from the viewpoint to permit playing of repeated notes.

In addition, the action of the upright piano does not have the repetition lever, the repetition spring, the hammer roller and the drop screw. Thus, the touch of the keys of the upright piano is significantly different from the touch of the keys of the grand piano.

In upright pianos, improved actions have been suggested in order to permit more rapid playing of repeated notes on a single key.

One improvement of the action of the upright piano is, for example, as described below (see, Patent Document 1). This technique is referred to as a related art 1.

The action according to the related art 1 has a spring member provided on the pushing-up portion of the jack. When the pushing-up portion of the jack slips out under the pushed-up portion of the hammer butt, the spring member comes into contact with the regulating rail and forces the jack against the hammer butt.

When the piano player releases the key, the wippen and the jack move down. The jack pivots by the force received from the jack spring and the spring member. Then, the jack and the hammer butt engage with each other.

In addition, another improvement of the action of the upright piano is as described below (see, Patent Document 2). This technique is referred to as a related art 2.

In the action according to the related art 2, a compression coil is provided as a jack/repetition spring between the protruding end of the pushing-up portion of the jack and the catcher. When the pushing-up portion of the jack slips out under the pushed-up portion of the hammer butt, the jack/repetition spring forces the jack against the hammer butt. In addition, a hammer return spring is engaged with the hammer butt. The hammer return spring aids the motion of the hammer rebounding from the string after hitting it.

When the piano player releases the key, the wippen and the jack move down and the jack tail escapes from the regulating button. The jack pivots by the force received from the jack/repetition spring. Then, the jack and the hammer butt engage with each other.

RELATED ART DOCUMENT(S)

Patent Document(s)

Patent Document 1: Japanese Patent Laid-open No. 2006-91516

Patent Document 2: Japanese Patent No. 2656323

Non-Patent Document(s)

Non-patent Document 1: Isoharu Nishiguchi and Taro Mori, "Motto shiritai piano no shikumi", 1st edition, Ongaku No Tomosha, Apr. 30, 2005, pp. 65-77

SUMMARY OF THE INVENTION

Problems to be Solved by the Invention

The action of the upright piano according to the related art 1 has a following problem.

In the action according to the related art 1, the role of the spring member is to reinforce the jack spring. Timing at which the jack engages with the hammer butt after the piano player releases the key is when the gap is formed under the pushed-up portion of the hammer butt into which the protruding end of the pushing-up portion of the jack can be inserted. Thus, as the typical upright pianos, the piano player should wait until the key returns to its rest position in order to make the string vibrate to produce a note on the same key.

It is assumed that the elastic modulus of the spring member and the torque applied from the spring member to the jack are increased to forcefully insert the pushing-up portion of the jack under the pushed-up portion of the hammer butt. However, this way is unpractical because of the following trouble. When the pushing-up portion of the jack is inserted under the pushed-up portion of the hammer butt, a force is transmitted from the jack to the hammer butt. This force is smaller than the force that the jack pushes up the hammer butt when the piano player depresses the key. However, this force is enough to push up the hammer butt and pivot the hammer. Accordingly, the hammer butt pivots, and its hammer head hits the vibrating string to stop the vibration of the string. This is a significant problem in playing notes.

In addition, the action according to the related art 1 does not have the repetition lever, the repetition spring, the hammer roller, and the drop screw. The aforementioned first to third forces in the grand piano will not be generated. Thus, the touch of the keys is significantly different from that of the grand piano.

The action of the upright piano according to the related art 2 has a following problem.

In the action according to the related art 2, the role of the jack/repetition spring is to substitute for the jack spring. Timing at which the jack engages with the hammer butt after the piano player releases the key is when the gap is formed under the pushed-up portion of the hammer butt into which the protruding end of the pushing-up portion of the jack can be inserted. Thus, as the typical upright pianos, the piano player should wait until the key returns to its rest position in order to make the string vibrate to produce a note on the same key.

The Patent Document 2 describes that "the jack and the hammer butt engage with each other when the key rises by approximately half of the key dip distance from the lowest point of its travel to its rest position after the piano player releases the key". However, this results in a similar problem to the one in the related art 1. More specifically, inserting the pushing-up portion of the jack under the pushed-up portion of the hammer butt pushes up the hammer butt. The hammer pivots, and the hammer head hits the vibrating string to stop the vibration of the string. Accordingly, the construction described as "the jack and the hammer butt engage with each other when the key rises by approximately half of the key dip distance from the lowest point of its travel to its rest position after the piano player releases the key" is accompanied by a practical problem.

In addition, the hammer return spring merely returns the hammer toward a hammer rest rail after hitting the string. It is assumed that the elastic modulus of the hammer return spring and the torque applied from the hammer return spring to the hammer butt are increased to prevent the pivot motion of the hammer which otherwise occurs when the pushing-up portion of the jack is inserted under the pushed-up portion of the hammer butt. However, this results in transmittance of a force from the hammer return spring to the key, producing significantly heavy touch of the key.

It may be tolerated to stop the vibration of the string with the hammer head and to produce the significantly heavy touch of the key. However, it is impossible to play repeated notes as rapid as in the grand piano. This is because the piano player should wait until the key rises by approximately half of the key dip distance from the lowest point of its travel to its rest position in order to make the string vibrate to produce a note on the same key.

Furthermore, the jack/repetition spring is a compression coil. The direction of the force applied from the jack/repetition spring to the pushing-up portion of the jack tends to be varied and it is impossible to ensure uniformity of touch of the key.

In addition, the action according to the related art 2 does not have the repetition lever, the repetition spring, the hammer roller, and the drop screw. The first to third forces in the grand piano will not be generated. Thus, the touch of the keys is significantly different from that of the grand piano.

The present invention is provided to solve the aforementioned problems, and an object thereof is to provide a method of operating an action of an upright piano, as well as an action of an upright piano with which it is possible to play repeated notes on a single key as in the grand piano, the hammer is prevented from hitting the vibrating string even when the jack and the hammer butt engage with each other to permit playing of repeated notes on a single key, and the touch of the keys replicates a grand piano.

Means to Solve the Problem

The present invention has a following construction in order to solve the problems. In a method of operating an action of an upright piano having strings according to the invention as claimed in Claim 1, the action comprises a regulating rail, a jack stop rail, a main action rail, a damper stop rail, a wippen, a jack, a hammer butt, and a hammer, the action further comprising a jack spring between the wippen and a jack tail of the jack, the action being adapted to operate, when a piano player depresses a key, in such a manner that the wippen moves up with rotating, a protruding end of a pushing-up portion of the jack pushes up a pushed-up portion of the hammer butt from below, the hammer pivots and hits a corresponding string, the jack tail of the jack strikes a regulating button, and that a protruding end of the pushing-up portion slips out from under the pushed-up portion, wherein either one member of said regulating rail and said jack stop rail serves as a first rail; either one member of said first rail and said pushing-up portion has a first spring; the other member of said first rail and said pushing-up portion that does not have said first spring has a first spring rest adapted to come into contact with said first spring; either one member of said main action rail and said damper stop rail serves as a second rail; one member of said second rail, a hammer core of said hammer, a hammer shank of said hammer, and said hammer butt has a second spring; if one member of said hammer core, said hammer shank, and said hammer butt has said second spring, then said second rail has a second spring rest adapted to come into contact with said second spring, and if said second rail has said second spring, then one member of said hammer core, said hammer shank, and said hammer butt has the second spring rest adapted to come into contact with said second spring; when the piano player depresses said key and the protruding end of said pushing-up portion slips out from under said pushed-up portion, said first spring is bent between the member having said first spring and said first spring rest, and when the piano player releases said key, said wippen moves down with rotating, and said jack tail escapes from said regulating button, said first spring that has been bent between the member having said first spring and said first spring rest pushes the protruding end of said pushing-up portion against a surface that is located in front of and above said pushed-up portion of said hammer butt, and said pushing-up portion is inserted under said pushed-up portion; when said first spring forces said pushing-up portion under said pushed-up portion, said hammer pivots towards said string by a force applied from said pushing-up portion to said pushed-up portion, said second spring is bent between the member having said second spring and said second spring rest before the rotation hammer hits said string, said second spring that has been bent applies a force to said hammer, the force applied from said second spring that has been bent to said hammer stops the pivot motion of said hammer before pivoting hammer hits said string.

When the piano player depresses a key, the protruding end of the pushing-up portion of the jack slips out from under the pushed-up portion of the hammer butt. The first spring is bent between the member having the first spring and the first spring rest. The bent first spring applies a force to the pushing-up portion of the jack.

Next, when the piano player releases the key, the wippen moves down with rotating. As the jack tail escapes from the regulating button, the jack receives a force from the first spring and pivots towards the hammer butt. When the jack pivots towards the hammer butt, the protruding end of the pushing-up portion of the jack is pushed against the surface that is located in front of and above the pushed-up portion of the hammer butt. The force produced by the first spring is applied to the hammer butt through the jack. The force produced by the first spring pushes up the hammer butt. The hammer butt then pivots on a hammer butt flange. The first spring forcefully pushes the protruding end of the pushing-up portion of the jack under the pushed-up portion of the hammer butt. Thus, the jack engages with the hammer butt.

When the jack engages with the hammer butt, the hammer butt pivots by receiving the force produced by the first spring, and the hammer also pivots towards the string. Then, the second spring is bent between the member having the second spring and the second spring rest. The bent second spring applies a force to the pivoting hammer. The force produced by the second spring stops the pivot motion of the hammer before the hammer hits the string. It should be noted that the force applied from the second spring to the hammer has a component opposite to the string, that is, a component of the force directing forward.

Because of the construction of upright pianos, when the jack tail escapes from the regulating button, the key rises by approximately one third of the key dip distance from the lowest point of its travel to its rest position. This means that, when the key rises by approximately one third of the key dip distance from the lowest point of its travel to its rest position, the force produced by the first spring forcefully engages the jack with the hammer butt. As a result, the piano player can depress the same key again and make the string vibrate to produce a note.

When either one member of the hammer core, the hammer shank, and the hammer butt has the second spring rest, the second spring rest rotates along with the hammer. The closer the second spring rest is located to the hammer butt flange, the slower the second spring rest rotates. Accordingly, the closer the second spring rest is located to the hammer butt flange, the smaller the sound produced as the second spring strikes the second spring rest.

When the second rail has the second spring rest, the second spring rotates along with the hammer. The closer the position of the second spring abutted against the second spring rest is located to the hammer butt flange, the slower that position rotates. Accordingly, the closer the position of the second spring abutted against the second spring rest is located to the hammer butt flange, the smaller the sound produced as the second spring strikes the second spring rest.

A portion of the second spring that is to be abutted against the second spring rest may be covered with a flexible material. In addition, a portion of the second spring rest that is to be abutted against the second spring may be covered with a flexible material. The flexible material may be, for example, a fabric such as felt, a resin, or leather. This reduces the sound produced as the second spring strikes the second spring rest.

From the viewpoint of the magnitude of the torque that the second spring applies to the hammer, the second spring requires smaller elastic modulus as the point of application of the force applied from the second spring to the hammer leaves away from the rotation center of the hammer. The rotation center of the hammer is on the hammer butt flange. By adjusting the elastic modulus of the second spring and the location of the point of application of the force applied from the second spring to the hammer, the influence of the second spring on the touch of the key can be adjusted.

The piano player feels the following fourth to sixth forces. The fourth force is transmitted from the first spring to the key. The fifth force is transmitted to the key when the jack engages with the hammer butt. The sixth force is transmitted to the key when the pivot motion of the hammer is stopped by the force produced by the second spring. These three forces are responsible for determining the touch of the key. That touch replicates a grand piano. This is because the fourth force corresponds to the first force in the grand piano. In addition, the fifth force corresponds to the second force in the grand piano. Furthermore, the sixth force corresponds to the third force in the grand piano.

It should be noted that a jack stop rail or a regulating rail used in a conventional upright piano may serve, for example, as the first rail. Alternatively, the first rail may be an additional rail provided between the action brackets. On the other hand, a main action rail or a damper stop rail used in a conventional upright piano may serve, for example, as the second rail. Alternatively, the second rail may be an additional rail provided between the action brackets.

A part of the member having the first spring rest may form the first spring rest. In addition, the member having the first spring rest may have a component forming the first spring rest.

A part of the member having the second spring rest may form the second spring rest. In addition, the member having the second spring rest may have a component forming the second spring rest.

According to the finding of the present inventor, it is not preferable that the first spring also doubles as the jack spring. If the first spring doubles as the jack spring, the keys will have a very heavy touch of the key when the piano player depresses the keys in their rest positions. This is because the force applied from the first spring to the jack is larger than the force applied from the jack spring to the jack.

In an action of an upright piano having strings according to the invention as claimed in Claim 2, the action comprises a regulating rail, a jack stop rail, a main action rail, a damper stop rail, a wippen, a jack, a hammer butt, and a hammer, the action further comprising a jack spring between the wippen and a jack tail of the jack, the action being adapted to operate, when a piano player depresses a key, in such a manner that the wippen moves up with rotating, a protruding end of a pushing-up portion of the jack pushes up a pushed-up portion of the hammer butt from below, the hammer pivots and hits a corresponding string, the jack tail of the jack strikes a regulating button, and that a protruding end of the pushing-up portion slips out from under the pushed-up portion, wherein either one member of said regulating rail and said jack stop rail serves as a first rail; either one member of said first rail and said pushing-up portion has a first spring; the other member of said first rail and said pushing-up portion that does not have said first spring has a first spring rest adapted to come into contact with said first spring; either one member of said main action rail and said damper stop rail serves as a second rail; one member of said second rail, a hammer core of said hammer, a hammer shank of said hammer, and said hammer butt has a second spring; if one member of said hammer core, said hammer shank, and said hammer butt has said second spring, then said second rail has a second spring rest adapted to come into contact with said second spring, and if said second rail has said second spring, then one member of said hammer core, said hammer shank, and said hammer butt has the second spring rest adapted to come into contact with said second spring; said action being adapted to produce a first force and a second force, the first force being applied by said first spring that has been bent between the member having said first spring and said first spring rest to said pushing-up portion when the piano player releases said key, said wippen moves down with rotating, and said jack tail escapes from said regulating button, the second force being applied by said second spring that has been bent between the member having said second spring and said second spring rest to said hammer when said first spring forces said pushing-up portion under said pushed-up portion and said hammer pivots towards said string by the force applied from said pushing-up portion to said pushed-up portion, the first force having magnitude and direction that press the protruding end of said pushing-up portion to a surface located in front of and above said pushed-up portion of said hammer butt and the force having magnitude and direction that force said pushing-up portion under said pushed-up portion, the second force having magnitude and direction that stop the pivot motion of said hammer before said hammer hits said string.

The invention as claimed in Claim 1 is implemented by the invention as claimed in Claim 2.

The action of an upright piano according to the invention as claimed in Claim 3 is the action of an upright piano as claimed in Claim 2, wherein said first spring is a leaf spring or a torsion coil spring, said first spring having a leg adapted to be abutted against said first spring rest.

The leg of the first spring comes into contact with the first spring rest, which results in the application of a force from the first spring to the pushing-up portion of the jack. By changing the shape of the leg abutted against the first spring rest, the magnitude of the force or the torque applied from the first spring to the pushing-up portion of the jack can be adjusted easily. To change the shape of the leg of the first spring, the degree of flexure or bent of the leg may be changed, for example.

According to the examinations made by the present inventor, when the first spring is a leaf spring or a torsion coil spring, the direction and the magnitude of the force applied from the first spring to the first spring rest is less fluctuated. This ensures uniformity of touch of the keys.

It is more preferable that the first spring is a torsion coil spring. The elastic modulus of the first spring can be adjusted easily by changing the number of windings in a coil or a diameter of the coil.

The action of an upright piano according to the invention as claimed in Claim 4 is the action of an upright piano as claimed in Claim 2 or 3, wherein said second spring is a leaf spring or a torsion coil spring, said second spring having a leg adapted to be abutted against said second spring rest.

The leg of the second spring comes into contact with the second spring rest, which results in the application of a force from the second spring to the hammer. By changing the shape of the leg abutted against the second spring rest, the magnitude of the force or the torque applied from the second spring to the hammer can be adjusted easily. To change the shape of the leg of the second spring, the degree of flexure or bent of the leg may be changed, for example.

It is more preferable that the second spring is a torsion coil spring. The elastic modulus of the second spring can be adjusted easily by changing the number of windings in a coil or a diameter of the coil.

According to the examinations made by the present inventor, when the second spring is a leaf spring or a torsion coil spring, the direction and the magnitude of the force applied from the second spring to the second spring rest is less fluctuated. This ensures uniformity of touch of the keys.

The action of an upright piano according to the invention as claimed in Claim 5 is the action of an upright piano as claimed in any one of Claims 2 to 4, wherein a first bolt is threaded with and passes through one member of said first rail and said pushing-up portion that has said first spring rest, a tip of a threaded portion of the first bolt supporting said first spring rest.

The tip of the threaded portion of the first bolt is projected out of a bolted member. Changing the length of the projection facilitates adjustment of the contact between the first spring and the first spring rest. By adjusting this contact, the magnitudes of the force and torque that the first spring applies to the pushing-up portion of the jack can be adjusted easily.

The action of an upright piano according to the invention as claimed in Claim 6 is the action of an upright piano as claimed in any one of Claims 2 to 5, wherein a second bolt is threaded with and passes through one member of said second rail, said hammer core, said hammer shank, and said hammer butt that has said second spring rest, a tip of a threaded portion of the second bolt supporting said second spring rest.

The tip of the threaded portion of the second bolt is projected out of a bolted member. Changing the length of the projection facilitates adjustment of the contact between the second spring and the second spring rest. By adjusting this contact, the magnitudes of the force and torque that the second spring applies to the hammer can be adjusted easily.

Effect of the Invention

The method of operating the action of the upright piano as well as the action of the upright piano as described above permits playing of repeated notes on the single key, which is comparable to grand pianos. Even when the jack engages with the hammer butt to repeat a note, the hammer is prevented from hitting the vibrating string. The resulting touch of the key is equivalent to that offered by a grand piano.

EMBODIMENTS FOR CARRYING OUT THE INVENTION

Embodiments for carrying out the present invention are described with reference to FIGS. 1 to 5. In the following description, expressions "clockwise" or "counter-clockwise" refer to a clockwise or counter-clockwise direction, respectively, from the perspective of FIGS. 1 to 3.

Figure 1:
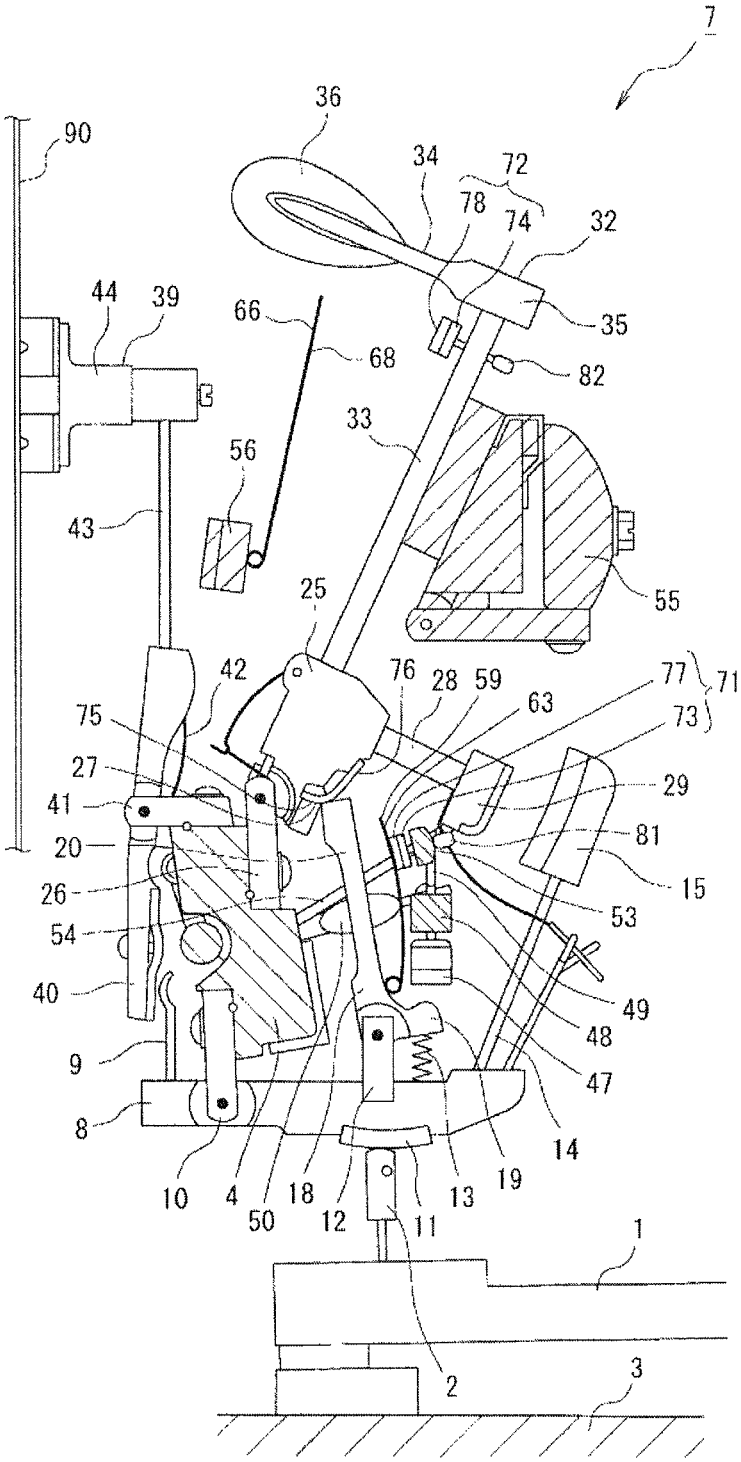
FIG. 1 A construction view showing an action of an upright piano when a key is in its rest position.
Figure 2:
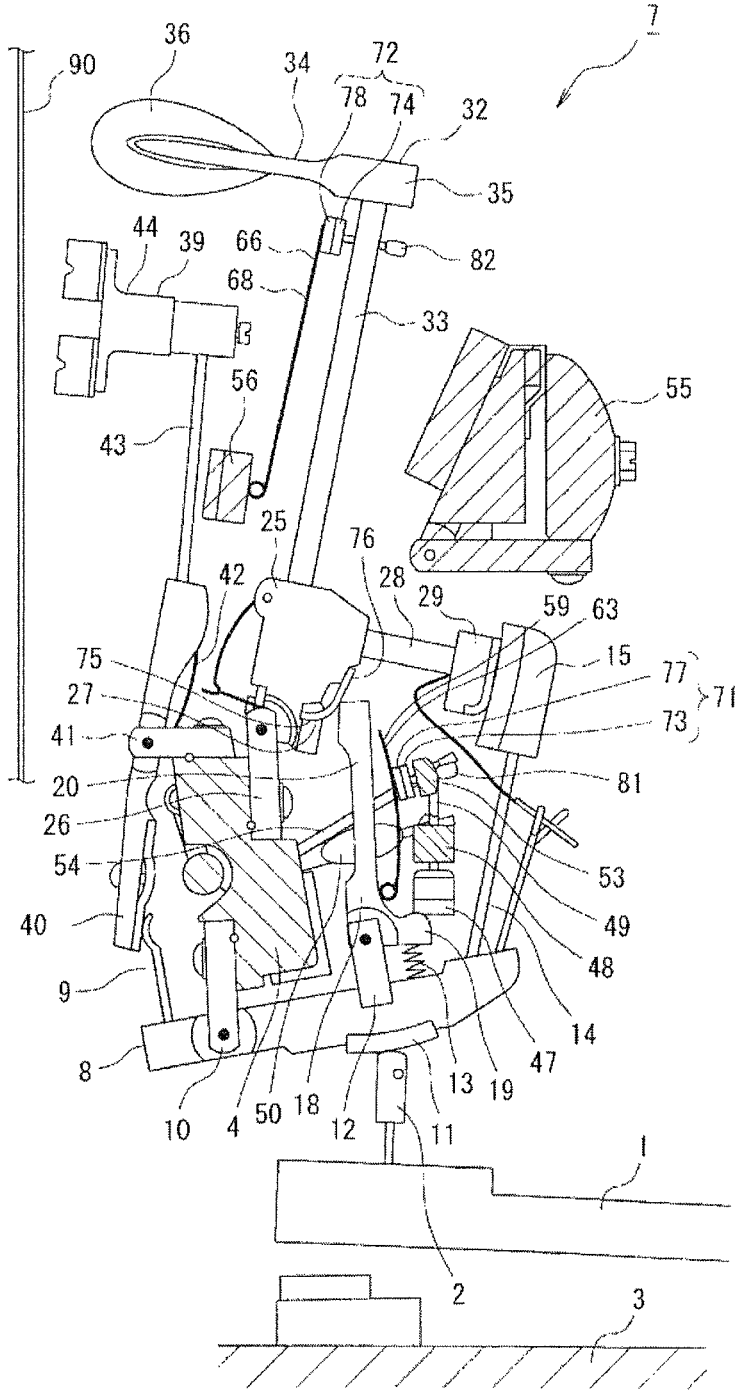
FIG. 2 A construction view showing the action of an upright piano immediately after the key is fully depressed and the hammer hits a string.
Figure 3:
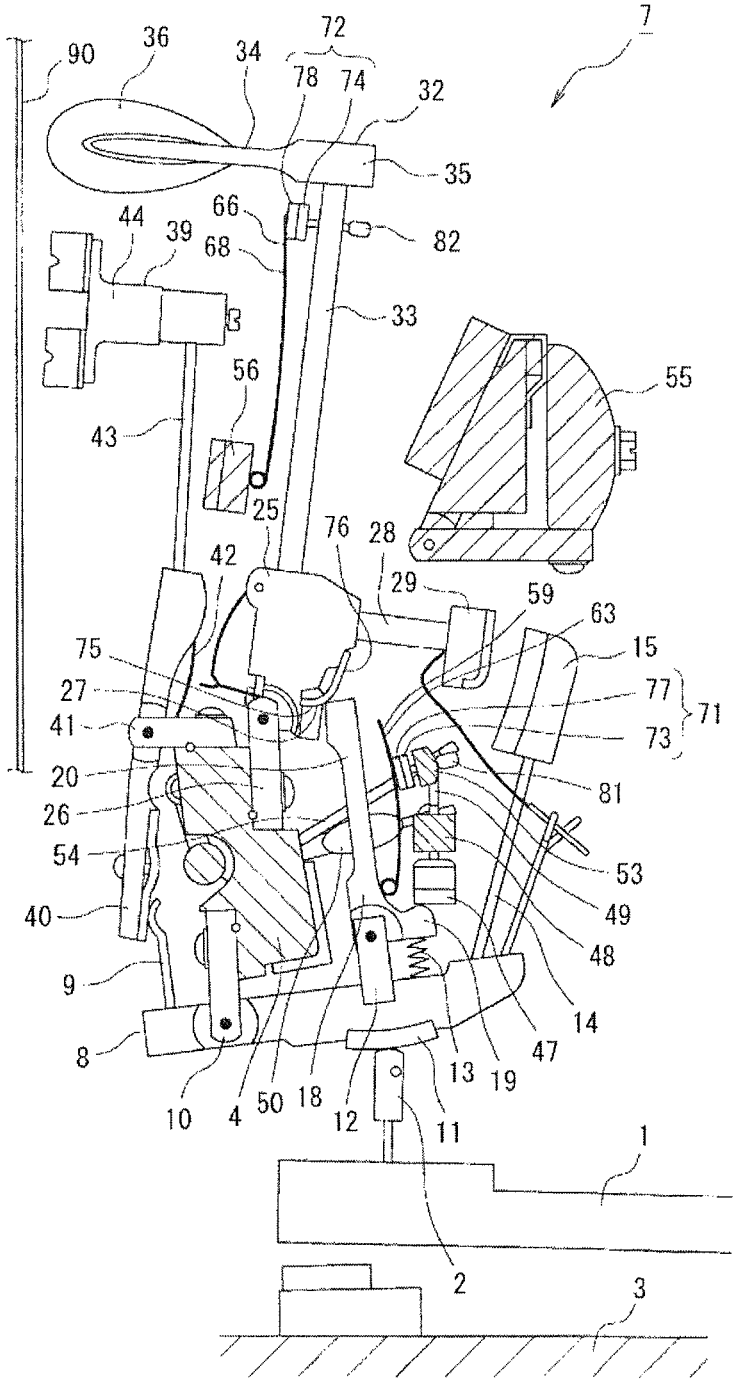
FIG. 3 A construction view showing the action of an upright piano at a time when the key is returned by one third of a key dip distance from the lowest point of its travel to its rest position.

As shown in FIGS. 1 to 3, an upright piano according to this embodiment has a set of keys 1 (only one of which is shown) aligned horizontally and strings 90 that correspond to the respective keys 1. Balance rail pins (not shown) are provided on a key frame 3. Each key 1 is supported by a balance rail pin in the center of the key 1 so that the key 1 can rock on a fulcrum. Action brackets (not shown) are provided on each end of the key frame 3. The action brackets hold a main action rail 4 between them.

An action 7 extends back and upward from the key 1. The action 7 comprises a wippen 8, a jack 18, a hammer butt 25, a hammer 32, and a damper 39. FIGS. 1 to 3 show the action 7 in a perspective from the left side.

A spoon 9 extends upward from the back end of the wippen 8. A wippen flange 10 is attached to a lower part of the main action rail 4. The wippen 8 is hinged with the wippen flange 10 at a position slightly ahead of the spoon 9. The wippen 8 has a heel 11 on the lower side thereof and has a jack flange 12 on the upper side thereof. The heel 11 and the jack flange 12 are located ahead of the wippen flange 10. The heel 11 rests on a capstan 2 inserted into the tail of the key 1. A back check wire 14 extends upward from the front end of the wippen 8. The back check wire 14 supports a back check 15 at the end thereof.

The jack 18 has a jack tail 19 and a pushing-up portion 20. The jack tail 19 projects upward and the pushing-up portion 20 extends vertically. The jack tail 19 and the pushing-up portion 20 form an "L" shape. At the corner of the "L" shape, the jack 18 is hinged with the jack flange 12. A jack spring 13 is provided between the jack tail 19 and the wippen 8 to force the jack tail 19 upward. A torsion coil spring forming a first spring 59 is attached to a lower end of the front surface of the pushing-up portion 20. The jack 18 is the member that has the first spring 59.

Figure 4:
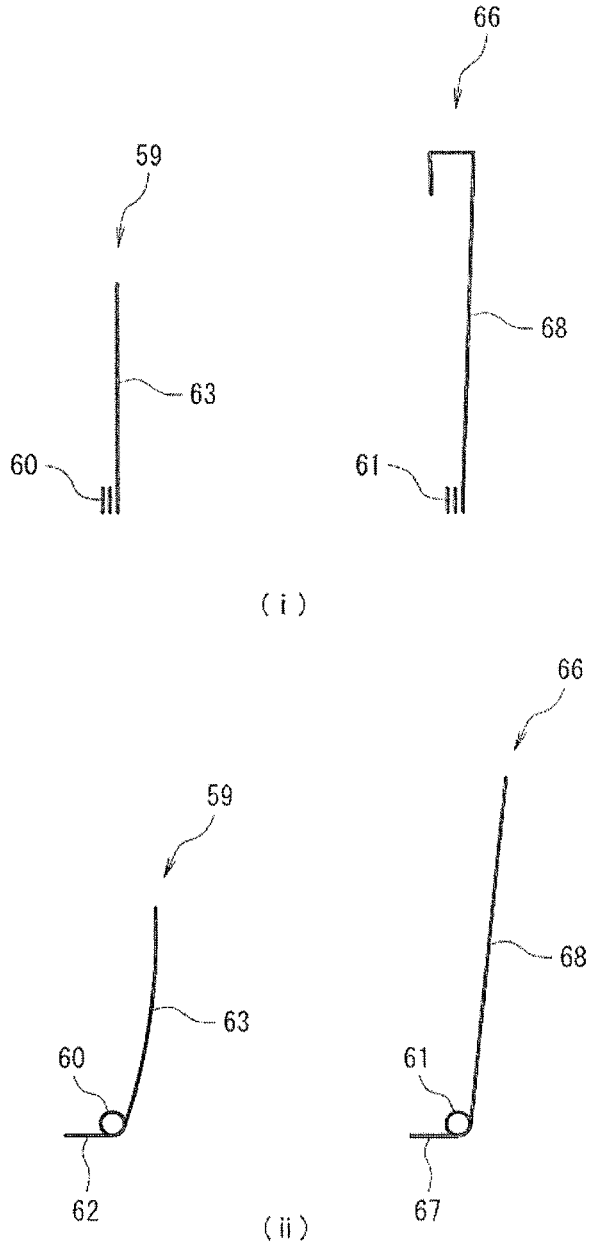
FIG. 4 A construction view showing a first spring and a second spring, in which (i) represents a front view of the first spring and the second spring, while (ii) represents a left side view of the first spring and the second spring.
Figure 5:
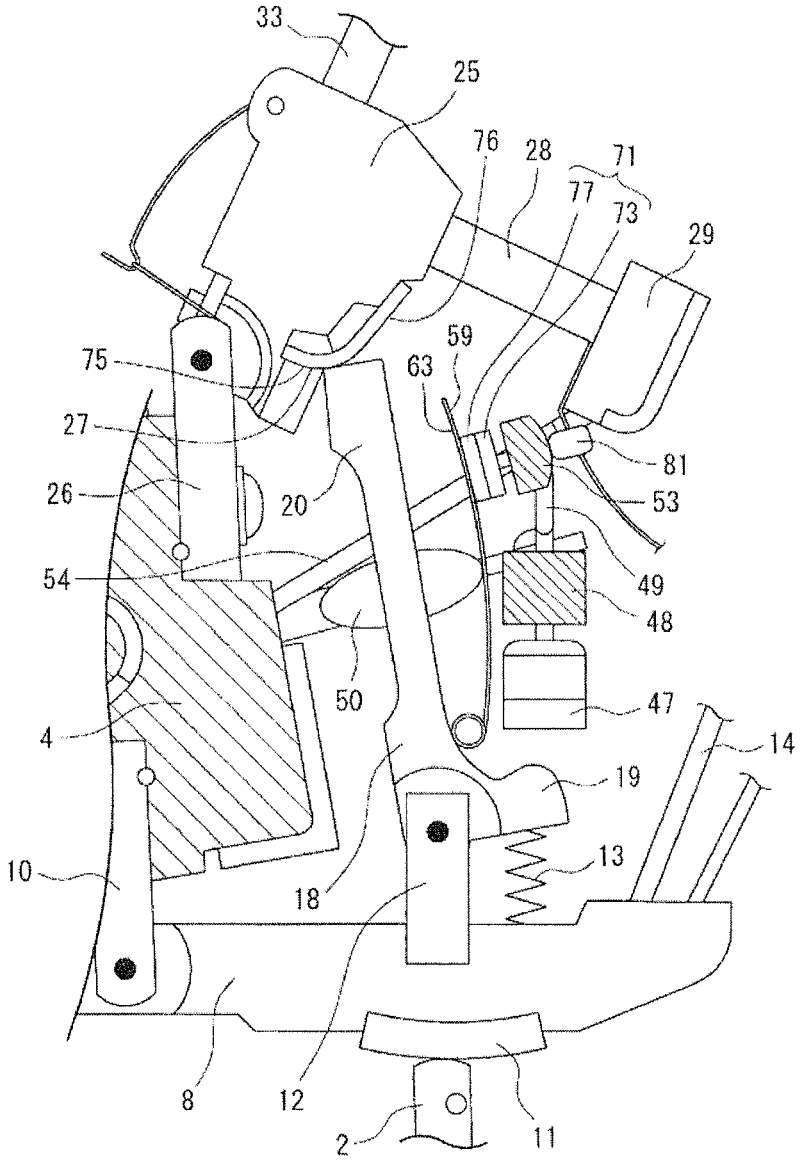
FIG. 5 A partially enlarged view of FIG. 1.

As shown in FIG. 4, the first spring 59 has a coil member 60 and two legs 62, 63. One end of the coil member 60 is connected to the leg 62 and the other end of the coil member 60 is connected to the leg 63. The leg 62 is embedded in the pushing-up portion 20. The leg 63 extends vertically and the upper end of the leg 63 is a free end. A regulating button 47 is provided above the jack tail 19. The regulating button 47 is supported at one end of a regulating screw 49. The regulating screw 49 is threaded with a regulating rail 48 extending horizontally. The regulating rail 48 is attached to the main action rail 4 with a fork screw 50.

A jack stop rail 53 is provided in front of the pushing-up portion 20. The jack stop rail 53 extends horizontally and serves as a first rail. The jack stop rail 53 is attached to the main action rail 4 with a regulating screw for the jack stop rail 54. A first bolt 81 is threaded with and passes through the jack stop rail 53. The tip of the threaded portion of the first bolt 81 projects from the back of the jack stop rail 53. A first spring rest 71 is supported at the end of the threaded portion of the first bolt 81. The jack stop rail 53 is the member that has the first spring rest 71.

The first spring rest 71 has a base 73 and a felt 77. The tip of the threaded portion of the first bolt 81 supports the base 73 from the front. The back surface of the base 73 has the felt 77 glued thereto. The felt 77 faces to the front surface of the pushing-up portion 20. The felt 77 has a width that is equal to or larger than the width (i.e., the right-and-left direction) of the pushing-up portion 20.

The elastic modulus of the first spring 59 and the torque that the first spring 59 applies to the jack 18 are adjusted as follows. The torque that the first spring 59 applies to the jack 18 is produced when the first spring 59 strikes the first spring rest 71 and is bent. The magnitudes of the elastic modulus and the torque are determined in order not to interfere with the let-off of the jack 18 when a piano player depresses the key 1. In addition, the magnitudes of the elastic modulus and the torque are determined so that the protruding end of the pushing-up portion 20 is forcefully inserted under a pushed-up portion 27 when the piano player releases the key 1.

A hammer butt flange 26 is attached to the upper front portion of the main action rail 4. The lower back surface of the hammer butt 25 is connected to the hammer butt flange 26 so that hammer butt 25 can pivot on the hammer butt flange 26. The upper front surface of the hammer butt 25 is connected to a catcher 29 through a catcher shank 28. The hammer butt 25 has the pushed-up portion 27 on the lower surface thereof. The pushed-up portion 27 has a leather skin 75 adhered to it. The front surface of the hammer butt 25 has a leather skin 76 at a position lower than the root of the catcher shank 28. In other words, the hammer butt 25 has the skin 76 adhered thereto at a position that is ahead of and above the pushed-up portion 27. The front-facing end of the skin 75 and the lower end of the skin 76 is integrally connected to each other.

The hammer 32 has a hammer shank 33 and a hammer head 34. The hammer shank 33 extends up from the upper surface of the hammer butt 25. The hammer head 34 is attached to the upper end of the hammer shank 33. The hammerhead 34 has a hammer core 35 and a hammer felt 36. The hammer core 35 extends back from the upper end of the hammer shank 33. The hammer felt 36 is glued to the back end of the hammer core 35.

A second bolt 82 is threaded with the hammer shank 33 near its upper end and passes through the hammer shank 33 in a front-to-back direction. The tip of the threaded portion of the second bolt 82 projects into the back of the hammer shank 33. A second spring rest 72 is supported at the end of the threaded portion of the second bolt 82. The hammer shank 33 is the member that has the second spring rest 72.

The second spring rest 72 has a base 74 and a felt 78. The tip of the threaded portion of the second bolt 82 supports the base 74 from the front. The back surface of the base 74 has the felt 78 glued thereto. The felt 78 faces back. The felt 78 has a width that is equal to or larger than the thickness of the hammer shank 33.

A damper 39 has a damper lever 40, a damper wire 43, and a damper head 44.

A damper flange 41 is attached to the upper back portion of the main action rail 4. The damper lever 40 is hinged with the damper flange 41 in the center of the damper lever 40. The lower front end of the damper lever 40 faces to one end of the spoon 9. The damper head 44 is connected to the upper end of the damper lever 40 through the damper wire 43. A damper spring 42 connected to the damper lever 40. The damper head 44 is pressed against the string 90 while being spring-loaded or biased with the damper spring 42.

A hammer stop rail 55 is provided in front of the hammer shank 33. A damper stop rail 56 is provided in front of the damper wire 43. The hammer stop rail 55 and the damper stop rail 56 are held between the action brackets. The damper stop rail 56 serves as a second rail.

A torsion coil spring forming a second spring 66 is attached to a front surface of the damper stop rail 56. The damper stop rail 56 is the member that has the second spring 66.

As shown in FIG. 4, the second spring 66 has a coil member 61 and two legs 67, 68. One end of the coil member 61 is connected to the leg 67 and the other end of the coil member 61 is connected to the leg 68. The leg 67 is embedded in the damper stop rail 56. The leg 68 has an angled "7" shaped end. The angled "7" shaped end of the leg 68 has a width (i.e., a length in the right-and-left direction) that is equal to or larger than the width (i.e., the length in the right-and-left direction) of the felt 78. The leg 68 extends diagonally upward and forward and the upper end thereof is a free end. The leg 68 has a length so that the leg 68 does not interfere with the hammer head 34 swinging about the hammer butt flange 26. In addition, the length of the leg 68 is determined so that the angled "U" shaped end of the leg 68 is abutted against the second spring rest 72 when the hammer shank 33 swings about the hammer butt flange 26.

The elastic modulus of the second spring 66 and the torque that the second spring 66 applies to the hammer 32 are adjusted as follows. The torque that the second spring 66 applies to the hammer 32 is produced when the second spring 66 is bent between the damper stop rail 56 and the second spring rest 72. The magnitudes of the elastic modulus and the torque are determined in order not to interfere with the hammer 32 hitting the string 90 when the piano player depresses the key 1. In addition, the magnitudes of the elastic modulus and the torque are determined so that the hammer 32 stops its motion before the hammer 32 hits the string 90 when the piano player releases the key 1.

The strings 90 are stretched behind the action 7.

The upright piano according to this embodiment is similar in construction to conventional upright pianos except that the action 7 has the first spring 59, the second spring 66, the first spring rest 71, and the second spring rest 72.

Next, an operation is described. First, a case is described where the key 1 is in its rest position (see FIGS. 1 and 5). When the key 1 is in its rest position, the front of the key 1 is located at the highest point of its travel while the tail of the key 1 is located at the lowest point of its travel. The wippen 8 is located at the lowest point of its travel.

The protruding end of the pushing-up portion 20 of the jack 18 is caught under the pushed-up portion 27 of the hammer butt 25. The pushing-up portion 20 is engaged with the pushed-up portion 27. The jack tail 19 is away from the regulating button 47. There is a gap between the pushing-up portion 20 and the first spring rest 71. There is also a gap between the end of the leg 63 of the first spring 59 and the front surface of the pushing-up portion 20. The leg 63 is abutted against the felt 77 of the first spring rest 71. It is preferable that the force that the leg 63 applies to the first spring rest 71 is as small as possible. It is most preferable that the force applied by the leg 63 to the first spring rest 71 is equal to zero.

The hammer butt 25 is located at the lowest point of its travel and the catcher 29 is also located at the lowest point of its travel. The catcher 29 is away from the back check 15. The hammer shank 33 is abutted against the hammer stop rail 55. The hammer head 34 is in its farthest position from the string 90. The leg 68 of the second spring 66 is away from the felt 78 of the second spring rest 72. The damper head 44 is pressed against the string 90 by a force from the damper spring 42.

Next, a case is described where a piano player depresses the key 1 in its rest position (see FIG. 2).

The piano player depresses the key 1 in its rest position. The key 1 pivots in the clockwise direction and the tail of the key 1 rises. The tail of the key 1 lifts the heel 11. The wippen 8 moves up with rotating on the wippen flange 10 in the counter-clockwise direction.

The rotation of the wippen 8 throws the spoon 9, pushing the lower end of the damper lever 40 backward. The damper lever 40 pivots on the damper flange 41 in the clockwise direction, moving the damper head 44 off the string 90.

When the wippen 8 moves up and rotates, the jack 18 moves up with the wippen 8. In the upward motion of the jack 18, the protruding end of the pushing-up portion 20 pushes up the pushed-up portion 27 of the hammer butt 25.

After the protruding end of the pushing-up portion 20 pushes the pushed-up portion 27, the front end of the wippen 8 keeps going up. The jack tail 19 strikes the regulating button 47, and the regulating button 47 pushes against the jack tail 19 from the above. The jack 18 pivots on the jack flange 12 in the clockwise direction. Then, the protruding end of the pushing-up portion 20 slips out or escapes from under the pushed-up portion 27. This disengagement is known as "let-off". The pushing-up portion 20 that has slipped out from under the pushed-up portion 27 approaches the first spring rest 71. The first spring 59 is bent between the pushing-up portion 20 and the first spring rest 71. The bent first spring 59 applies torque to the jack 18.

The magnitudes of the elastic modulus of the first spring 59 and the torque that the first spring 59 applies to the jack 18 are determined in order not to interfere with the let-off of the jack 18.

The hammer butt 25 pivots on the hammer butt flange 26 in the counter-clockwise direction as the jack 18 pushes the pushed-up portion 27. The hammer 32 pivots in the counter-clockwise direction along with the hammer butt 25. When the hammer 32 pivots, the leg 68 of the second spring 66 comes into contact with the second spring rest 72 and is bent. The bent second spring 66 applies torque to the hammer 32. The magnitudes of the elastic modulus of the second spring 66 and the torque that the second spring 66 applies to the hammer 32 are determined in order not to interfere with the hammer 32 hitting the string 90 when the piano player depresses the key 1. Thus, the hammer 32 hits the string 90 without being interfered with the second spring 66. This makes the string 90 vibrate and produce a note.

After hitting the string 90, the hammer 32 rebounds and pivots in the clockwise direction. Then, the catcher 29 is caught by the back check 15 and the hammer 32 is stopped. At this point, the front of the key 1 has already moved to the lowest point of its travel and the tail of the key 1 has already moved to the highest point of its travel. In addition, the protruding end of the pushing-up portion 20 is located above the pushed-up portion 27 and in front of the skin 76.

Next, a case is described where the piano player releases the key 1 and the front of the key 1 rises from the lowest point of its travel (see FIG. 3).

When the piano player releases the key 1, it pivots in the counter-clockwise direction and the tail of the key 1 starts to move down. As the tail of the key 1 moves down, the wippen 8 moves down with rotating in the clockwise direction. When the wippen 8 starts to move down, the catcher 29 disengages from the back check 15. This allows the hammer 32 to pivot.

Because of the construction of the upright piano, when the front of the key 1 rises by approximately one third of the key dip distance from the lowest point of its travel to its rest position (i.e., the tail of the key 1 falls by approximately one third of the key dip distance from the highest point of its travel to its rest position), the jack tail 19 simply rests against the regulating button 47. Thus, the force that the regulating button 47 applies to the jack tail 19 from above is equal to zero. At this time, the first spring 59 is bent between the pushing-up portion 26 and the first spring rest 71. The bent first spring 59 applies a force to the pushing-up portion 20. This force causes the jack 18 to pivot on the jack flange 12 in the counter-clockwise direction. As a result, the jack tail 19 is released from its contact with the regulating button 47, and the protruding end of the pushing-up portion 20 is pressed against the hammer butt 25. The position where the protruding end of the pushing-up portion 20 is pressed against is on the front surface of the hammer butt 25. More specifically, this position is located above the pushed-up portion 27 in the area where the skin 76 is attached. The protruding end of the pushing-up portion 20 is forcefully pushed under the pushed-up portion 27 by the force imparted by the first spring 59.

When the protruding end of the pushing-up portion is forcefully pushed under the pushed-up portion 27, the protruding end of the pushing-up portion 20 applies a force to the hammer butt 25. This force pushes up the hammer butt 25 and the hammer butt 25 thus pivots on the hammer butt flange 26 in the counter-clockwise direction. When the hammer butt pivots, the hammer 32 also pivots in the counter-clockwise direction. When the hammer 32 pivots, the leg 68 of the second spring 66 strikes the second spring rest 72. Then, the second spring 66 is bent between the damper stop rail 56 and the second spring rest 72. The bent second spring 66 applies torque to the hammer 32 through the second spring rest 72. The magnitudes of the elastic modulus of the second spring 66 and the torque that the second spring 66 applies to the hammer 32 are determined so that the hammer 32 stops its motion before the hammer 32 hits the string 90 when the piano player releases the key 1. In this way, the second spring 66 serves to stop the pivot motion of the hammer 32 before the hammer 32 hits the string 90. This prevents the hammer 32 from hitting the vibrating string 90 and from muting the vibration of the string 90.

When the protruding end of the pushing-up portion 20 is forcefully pushed under the pushed-up portion 27, the jack 18 engages with the hammer butt 25. When the piano player again depresses the released key 1, the pushing-up portion 20 pushes up the pushed-up portion 27.

In other words, the piano player can depress the same key 1 again and make the hammer 32 hit the vibrating string 90 after the front of the key 1 rises by approximately one third of the key dip distance from the lowest point of its travel to its rest position. This feature permits playing of repeated notes on the single key 1, which is comparable to grand pianos.

The piano player feels the fourth to sixth forces. Thus, the piano player has touch that replicates a grand piano.

The tip of the threaded portion of the first bolt 81 is projected out of the back of the jack stop rail 53. The length of the projection can be changed easily. This change facilitates adjustment of the contact between the first spring 59 and the first spring rest 71. The magnitudes of the force and torque that the first spring 59 applies to the jack 18 can also be adjusted easily.

The tip of the threaded portion of the second bolt 82 is projected out of the back of the hammer shank 33. The length of the projection can be changed easily. This change facilitates adjustment of the contact between the second spring 66 and the second spring rest 72. The magnitudes of the force and torque that the second spring 66 applies to the hammer 32 can also be adjusted easily.

Figure 6:
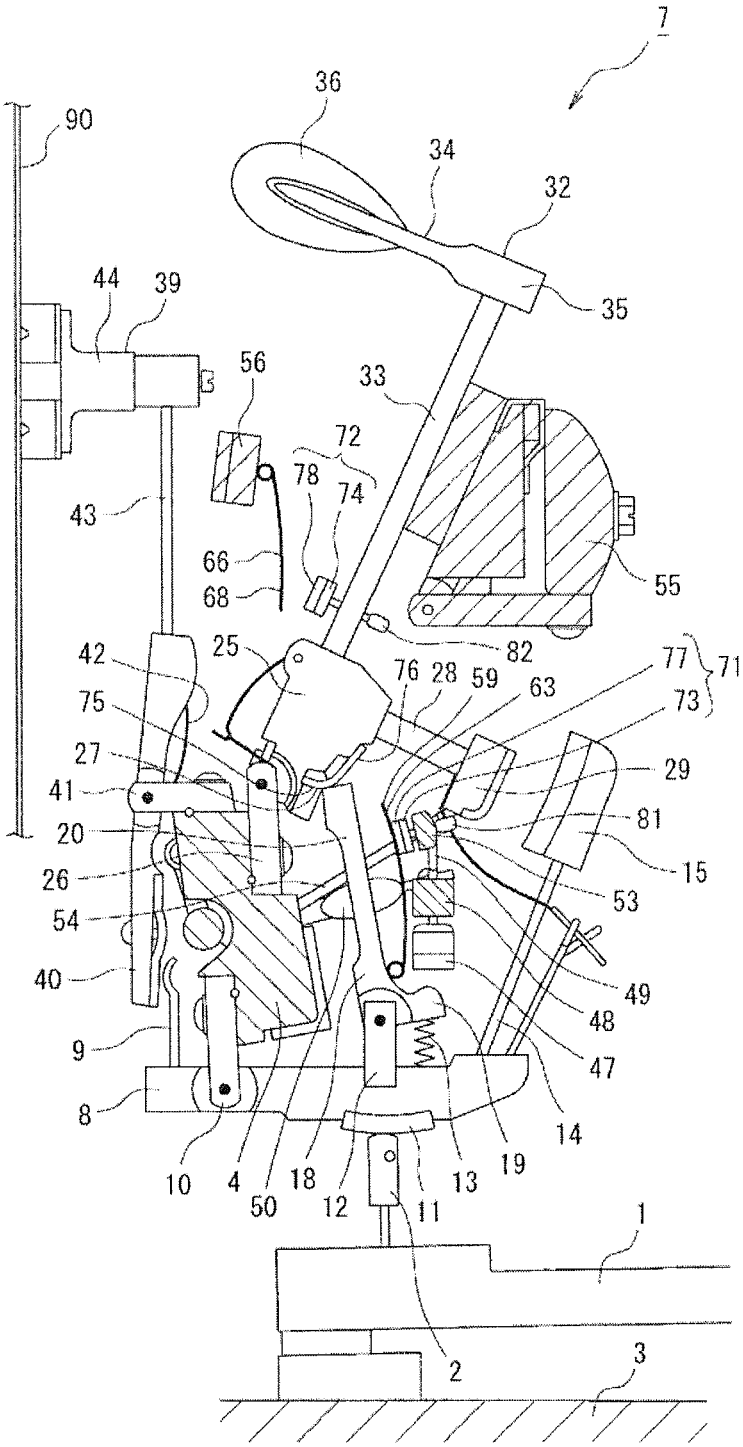
FIG. 6 A construction view showing an action of an upright piano according to a first modified version, immediately after the key is fully depressed and the hammer hits a string.

In this embodiment, the leg 68 of the second spring 66 extends diagonally upward and forward. Instead of this, a construction shown in a first modified version in FIG. 6 may be used. It should be noted that FIG. 6 shows the action 7 in a perspective from the left side. In the first modified version, the leg 68 extends diagonally downward and forward. The second spring rest 72 is formed near the bottom of the hammer butt 25 of the hammer shank 33. The second spring rest 72 rotates along with the hammer 32.

The closer the second spring rest 72 is located to the rotation center (i.e., the hammer butt flange 26) of the hammer 32, the slower the second spring rest 72 rotates. When the hammer 32 pivots and the leg 68 strikes the second spring rest 72, noise is produced. As the rotation speed of the second spring rest 72 decreases, the noise becomes weaker.

In this embodiment, the first spring rest 71 is supported by the first bolt 81. Instead of this, the felt 78 may be glued on the back of the jack stop rail 53. This felt 78 serves as the first spring rest 71.

In this embodiment, the second spring rest 72 is supported by the second bolt 82. Instead of this, the felt 77 may be wrapped around the hammer shank 33. This felt 77 serves as the second spring rest 72.

In this embodiment, the first spring rest 71 consists of the base 73 and the felt 77. Instead of this, the first spring rest 71 may have the following construction. The felt 77 is fixed to the back of the jack stop rail 53 at two points. The tip of the threaded portion of the first bolt 81 is abutted against the back of the area between the two points where the felt 77 is fixed. This felt 77 serves as the first spring rest 71.

The second spring rest 72 may have the following construction. The felt 78 is fixed to the back of the hammer shank 33 at two points. The tip of the threaded portion of the second bolt 82 is abutted against the back of the area between the two points where the felt 78 is fixed. This felt 78 serves as the second spring rest 72.

In this embodiment, each of the first spring 59 and the second spring 66 may be implemented with a leaf spring. In such a case, the longitudinal extremities of the leaf spring serve as the respective legs. One leg of the leaf spring corresponds to the leg 62 of the first spring 59 of the leg 67 of the second spring 66. The other leg of the leaf spring corresponds to the leg 63 of the first spring 59 or the leg 68 of the second spring 66. The part of the leaf spring near the leg corresponding to the leg 62 or the leg 67 is curved to a greater degree than other part of it. This large curve corresponds to the coil member 60 of the first spring 59 or the coil member 61 of the second spring 66.

In this embodiment, the leg 62 of the first spring 59 may be embedded in an additional rail provided between the action brackets, the jack stop rail 53, or the regulating rail 48. In such a case, the first spring rest 71 is provided in front of the pushing-up portion 20.

In this embodiment, the leg 67 of the second spring 66 may be embedded in the main action rail 4. This facilitates change in length of the leg 68, which in turn facilitates adjustment of the second spring 66. In addition, the leg 67 may be embedded in an additional rail provided between the action brackets.

In this embodiment, the leg 67 of the second spring 66 may be embedded in the hammer core 35, the hammer shank 33, or the hammer butt 25. In such a case, the second spring rest 72 is provided on an additional rail provided between the action brackets, the front surface of the damper stop rail 56, or the main action rail 4.

In this embodiment, the skins 75, 76 may be made of a woven fabric such as a wool fabric, a non-woven fabric, or a flexible resin. In addition, the felt 77, 78 may be replaced with leather, a woven fabric such as a wool fabric, a non-woven fabric or a flexible resin.

Figure 7:
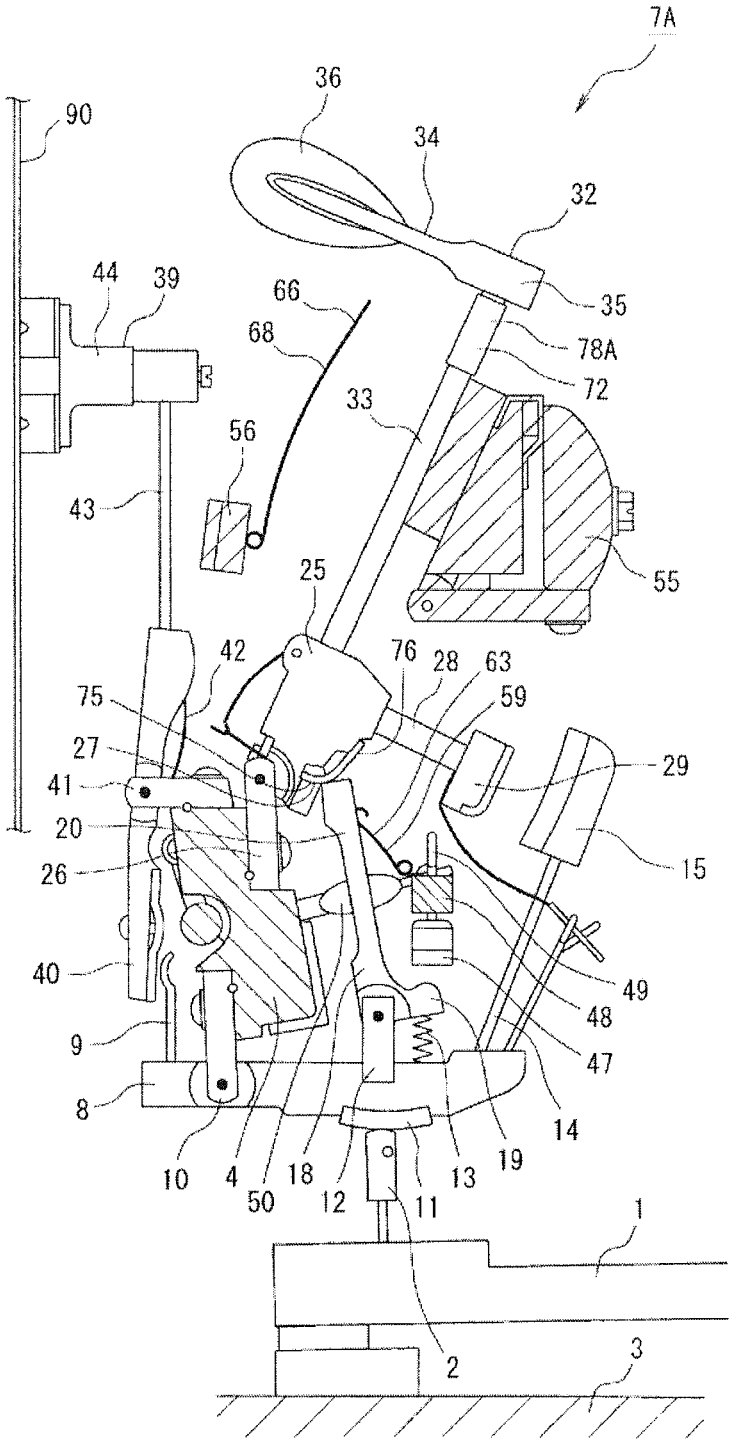
FIG. 7 A construction view showing an action of an upright piano according to a second modified version.

An action 7A according to a second modified version is shown in FIG. 7. FIG. 7 shows the action 7A in a perspective from the left side.

The action 7A is different from the aforementioned action 7 in the following points.

As shown in FIG. 7, the action 7A does not have a jack stop rail and a regulating screw for the jack stop rail.

Figure 8:
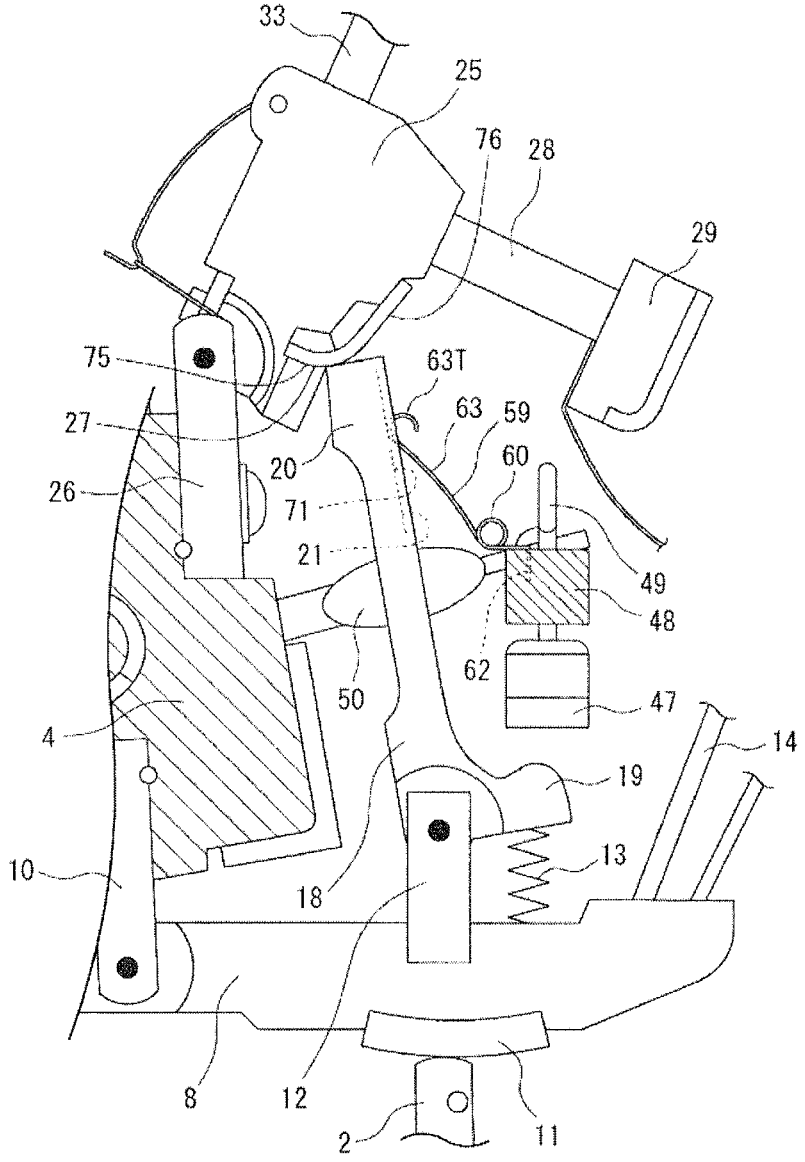
FIG. 8 A partially enlarged view of FIG. 7.
Figure 10:
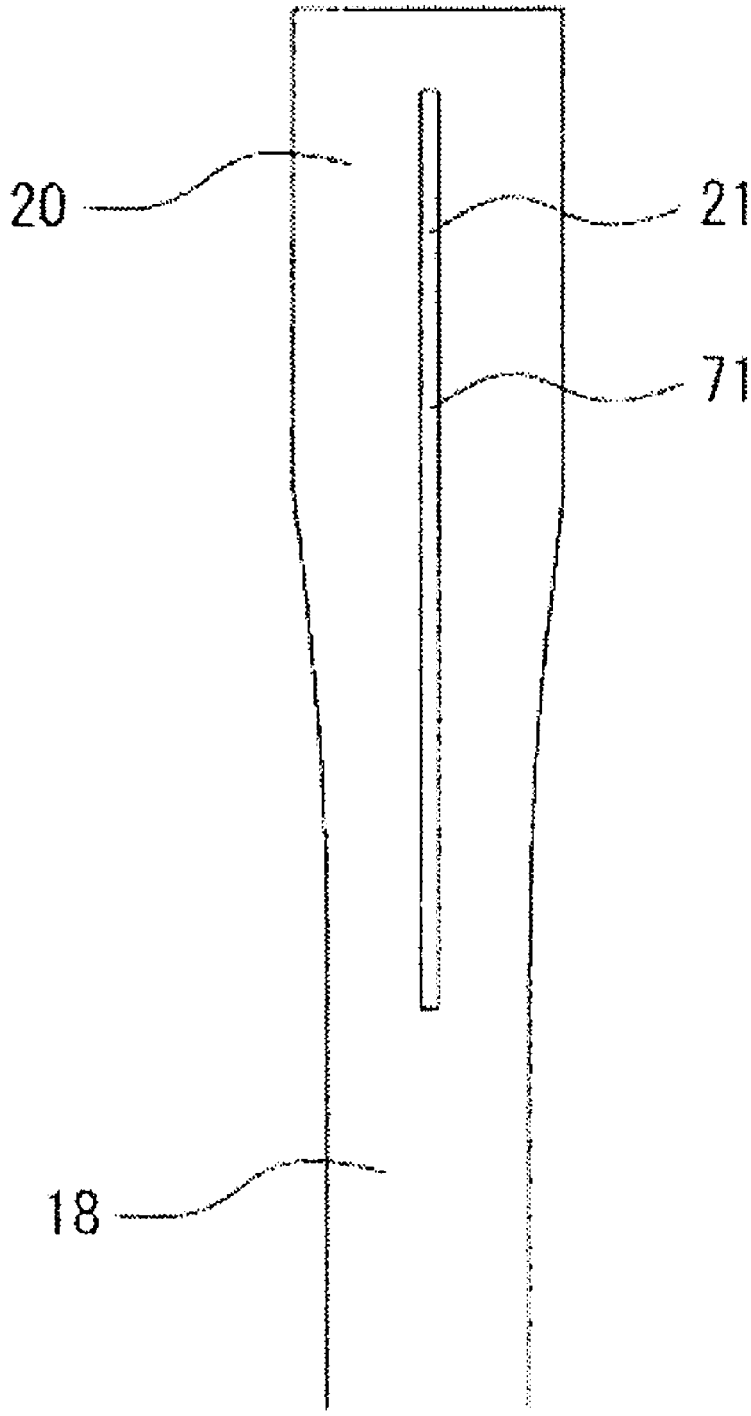
FIG. 10 A front view showing an upper part of a pushing-up portion of a jack according to the second modified version.

As shown in FIGS. 8 and 10, a groove 21 is formed in the front surface of the pushing-up portion 20 of the jack 18 at the upper end thereof. The groove 21 is continuous in the longitudinal direction of the pushing-up portion 20. The groove 21 serves as the first spring rest 71. The pushing-up portion 20 is the member that has the first spring rest 71.

Figure 9:
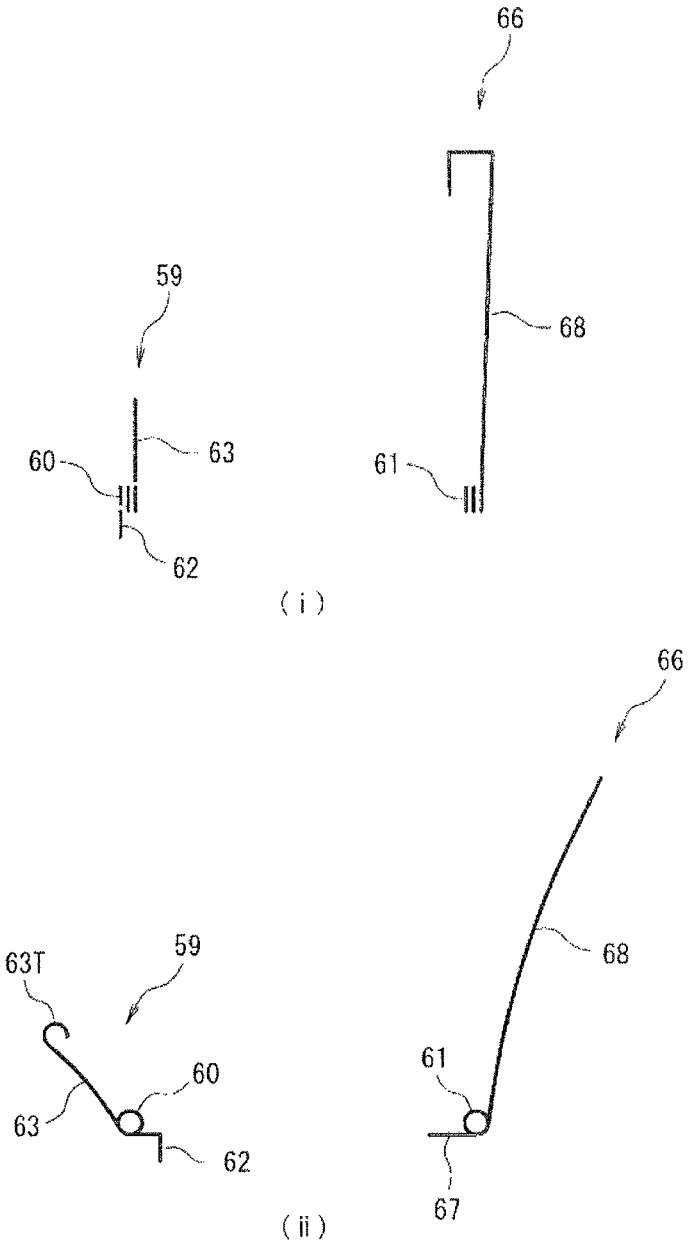
FIG. 9 A construction view showing a first spring and a second spring according to a second modified version, in which (i) represents a front view of the first spring and the second spring, while (ii) represents a left side view of the first spring and the second spring.

As shown in FIG. 9, the first spring 59 has the coil member 60 and two legs 62, 63. One end of the coil member 60 is connected to the leg 62 and the other end of the coil member 60 is connected to the leg 63. The leg 62 is embedded in the upper surface of the regulating rail 48. The regulating rail 48 is the member that has the first spring 59. The end of the leg 63 is a free end. The end 63T of the leg 63 is curved as an arc. The thickness of the leg 63 is slightly smaller than the width (i.e., the length in the right-and-left direction) of the groove 21. A part of the end 63T is abutted against the bottom of the groove 21.

When the key 1 is in its rest position, the leg 63 extends diagonally upward and backward from the coil member 60.

A felt 78A is wrapped around the upper end of the hammer shank 33. The felt 78A serves as the second spring rest 72. The hammer shank 33 is the member that has the second spring rest 72.

As shown in FIG. 9, the second spring 66 has the coil member 61 and two legs 67, 68. One end of the coil member 61 is connected to the leg 67 and the other end of the coil member 61 is connected to the leg 68. The leg 67 is embedded in the damper stop rail 56. The leg 68 has an angled "7" shaped end. The angled "7" shaped end of the leg 68 has a width (i.e., a length in the right-and-left direction) that is equal to or larger than the thickness of the hammer shank 33.

When the hammer shank 33 is in contact with the hammer stop rail 55, the leg 68 extends diagonally upward and forward from the coil member 61.

Other components of the action 7A are same as those in the action 7.

A part of the end 63T of the leg 63 of the first spring 59 is housed in the groove 21 in the pushing-up portion 20. When the first spring 59 is bent, the end 63T slips in the groove 21 in the longitudinal direction of the pushing-up portion 20. When the first spring 59 is bent, the end 63T is not deviated from the first spring rest 71.

Other operations and effects of the action 7A are similar to those achieved by using the action 7.

INDUSTRIAL APPLICABILITY

The method of operating the action of an upright piano according to the present invention is useful as a method by which the performance of an upright piano is improved. In addition, the action of an upright piano according to the present invention is useful as a construction by with the performance of an upright piano is improved.

DENOTATION OF SYMBOLS AND REFERENCE NUMERALS

1 keys
4 main action rail
7, 7A action
8 wippen
10 wippen flange
12 jack flange
15 back check
18 jack
19 jack tail
20 pushing-up portion
21 groove
25 hammer butt
26 hammer butt flange
27 pushed-up portion
29 catcher
32 hammer
33 hammer shank
34 hammer head
35 hammer core
39 damper
47 regulating button
53 jack stop rail
56 damper stop rail
59 first spring
62, 63 leg of first spring
66 second spring
67, 68 leg of second spring
71 first spring rest
72 second spring rest
81 first bolt
82 second bolt
90 strings

The invention claimed is:

1. A method of operating an action of an upright piano having strings, the action comprising a regulating rail, a jack stop rail, a main action rail, a damper stop rail, a wippen, a jack, a hammer butt, and a hammer, the action further comprising a jack spring between the wippen and a jack tail of the jack, the action being adapted to operate, when a piano player depresses a key, in such a manner that the wippen moves up with rotating, a protruding end of a pushing-up portion of the jack pushes up a pushed-up portion of the hammer butt from below, the hammer pivots and hits a corresponding string, the jack tail of the jack strikes a regulating button, and that a protruding end of the pushing-up portion slips out from under the pushed-up portion, wherein either one member of said regulating rail and said jack stop rail serves as a first rail;

either one member of said first rail and said pushing-up portion has a first spring;

the other member of said first rail and said pushing-up portion that does not have said first spring has a first spring rest adapted to come into contact with said first spring;

either one member of said main action rail and said damper stop rail serves as a second rail;

one member of said second rail, a hammer core of said hammer, a hammer shank of said hammer, and said hammer butt has a second spring;

if one member of said hammer core, said hammer shank, and said hammer butt has said second spring, then said second rail has a second spring rest adapted to come into contact with said second spring, and if said second rail has said second spring, then one member of said hammer core, said hammer shank, and said hammer butt has the second spring rest adapted to come into contact with said second spring;

when the piano player depresses said key and the protruding end of said pushing-up portion slips out from under said pushed-up portion, said first spring is bent between the member having said first spring and said first spring rest, and when the piano player releases said key, said wippen moves down with rotating, and said jack tail escapes from said regulating button, said first spring that has been bent between the member having said first spring and said first spring rest pushes the protruding end of said pushing-up portion against a surface that is located in front of and above said pushed-up portion of said hammer butt, and said pushing-up portion is inserted under said pushed-up portion;

when said first spring forces said pushing-up portion under said pushed-up portion, said hammer pivots towards said string by a force applied from said pushing-up portion to said pushed-up portion, said second spring is bent between the member having said second spring and said second spring rest before the rotation hammer hits said string, said second spring that has been bent applies a force to said hammer, the force applied from said second spring that has been bent to said hammer stops the pivot motion of said hammer before pivoting hammer hits said string.

2. An action of an upright piano having strings, the action comprising a regulating rail, a jack stop rail, a main action rail, a damper stop rail, a wippen, a jack, a hammer butt, and a hammer, the action further comprising a jack spring between the wippen and a jack tail of the jack, the action being adapted to operate, when a piano player depresses a key, in such a manner that the wippen moves up with rotating, a protruding end of a pushing-up portion of the jack pushes up a pushed-up portion of the hammer butt from below, the hammer pivots and hits a corresponding string, the jack tail of the jack strikes a regulating button, and that a protruding end of the pushing-up portion slips out from under the pushed-up portion, wherein either one member of said regulating rail and said jack stop rail serves as a first rail;

either one member of said first rail and said pushing-up portion has a first spring;

the other member of said first rail and said pushing-up portion that does not have said first spring has a first spring rest adapted to come into contact with said first spring;

either one member of said main action rail and said damper stop rail serves as a second rail;

one member of said second rail, a hammer core of said hammer, a hammer shank of said hammer, and said hammer butt has a second spring;

if one member of said hammer core, said hammer shank, and said hammer butt has said second spring, then said second rail has a second spring rest adapted to come into contact with said second spring, and if said second rail has said second spring, then one member of said hammer core, said hammer shank, and said hammer butt has the second spring rest adapted to come into contact with said second spring;

said action being adapted to produce a first force and a second force, the first force being applied by said first spring that has been bent between the member having said first spring and said first spring rest to said pushing-up portion when the piano player releases said key, said wippen moves down with rotating, and said jack tail escapes from said regulating button, the second force being applied by said second spring that has been bent between the member having said second spring and said second spring rest to said hammer when said first spring forces said pushing-up portion under said pushed-up portion and said hammer pivots towards said string by the force applied from said pushing-up portion to said pushed-up portion, the first force having magnitude and direction that press the protruding end of said pushing-up portion to a surface located in front of and above said pushed-up portion of said hammer butt and the force having magnitude and direction that force said pushing-up portion under said pushed-up portion, the second force having magnitude and direction that stop the pivot motion of said hammer before said hammer hits said string.

3. The action of an upright piano as claimed in claim 2, wherein said first spring is a leaf spring or a torsion coil spring, said first spring having a leg adapted to be abutted against said first spring rest.

4. The action of an upright piano as claimed in claim 2, wherein said second spring is a leaf spring or a torsion coil spring, said second spring having a leg adapted to be abutted against said second spring rest.

5. The action of an upright piano as claimed in claim 2, wherein a first bolt is threaded with and passes through one member of said first rail and said pushing-up portion that has said first spring rest, a tip of a threaded portion of the first bolt supporting said first spring rest.

6. The action of an upright piano as claimed in claim 2, wherein a second bolt is threaded with and passes through one member of said second rail, said hammer core, said hammer shank, and said hammer butt that has said second spring rest, a tip of a threaded portion of the second bolt supporting said second spring rest.

7. A method of controlling touch of keys of an upright piano having strings by means of modifying an action of the upright piano, the action comprising a regulating rail, a jack stop rail, a main action rail, a damper stop rail, a wippen, a jack, a hammer butt, and a hammer, the action further comprising a jack spring between the wippen and a jack tail of the jack, the action being adapted to operate, when a piano player depresses a key, in such a manner that the wippen moves up with rotating, a protruding end of a pushing-up portion of the jack pushes up a pushed-up portion of the hammer butt from below, the hammer pivots and hits a corresponding string, the jack tail of the jack strikes a regulating button, and that a protruding end of the pushing-up portion slips out from under the pushed-up portion, said method comprising the steps of:

attaching a first spring to either one member of said regulating rail, said jack stop rail, and said pushing-up portion, and attaching a first spring rest to the other member of said pushing-up portion and a first rail that does not have said first spring, the first rail being consisted of either one member of said regulating rail and said jack stop rail, the first spring rest being adapted to come into contact with said first spring;

attaching a second spring to one member of said main action rail, said damper stop rail, a hammer core of said hammer, a hammer shank of said hammer, and said hammer butt, and attaching a second spring rest to either one of said hammer core, said hammer shank, and said hammer butt if a second rail has the second spring out of the second rail, said hammer core, said hammer shank, and said hammer butt, the second rail being consisted of either one member of said main action rail and said damper stop rail, while attaching the second spring rest to said second rail if either one of said hammer core, said hammer shank, and said hammer butt has said second spring, the second spring rest being adapted to come into contact with said second spring;

making a force applied by said first spring that has been bent between the member having said first spring and said first spring rest to said pushing-up portion when the piano player releases said key, said wippen moves down with rotating, and said jack tail escapes from said regulating button, have magnitude and direction that press the protruding end of said pushing-up portion to a surface located in front of and above said pushed-up portion of said hammer butt, and have magnitude and direction that force said pushing-up portion under said pushed-up portion; and making a force applied by said second spring that has been bent between the member having said second spring and said second spring rest to said hammer when said first spring forces said pushing-up portion under said pushed-up portion and said hammer pivots towards said string by the force applied from said pushing-up portion to said pushed-up portion, have magnitude and direction that stop the pivot motion of said hammer before said hammer hits said string.

8. An action of an upright piano having strings, the action including a hammer that pivots and strikes a string when a piano player depresses a key; a jack that moves up with rotating when the piano player depresses said key; and a hammer butt that is pushed up by said jack to pivot said hammer when said jack moves up with rotating, said jack having a pushing-up portion to push up said hammer butt, said hammer butt having a pushed-up portion that is pushed up by said jack;

said action comprising:

a first elastic body adapted to apply such a force to said jack that forcefully returns said pushed-up portion of said jack under said pushing-up portion of said hammer butt after said hammer butt has been pushed up; and a second elastic body adapted to apply such a force to said hammer that does not interfere with said hammer hitting said string when the hammer is in the course of a first pivot motion towards said string in response to depression of the key by the piano player, and that interferes with said hammer hitting said string when the hammer is in the course of a second pivot motion towards said string by said hammer butt that has moved up, if said pushed-up portion of said jack is forcefully returned under said pushing-up portion of said hammer butt by the force applied by said first elastic body.

9. An upright piano having the action as claimed in claim 2.

* * * * *